United States Patent [19]

Focke et al.

[11] Patent Number: 5,007,522

[45] Date of Patent: Apr. 16, 1991

[54] APPARATUS FOR TRANSPORTING PACKAGING MATERIAL TO A PACKAGING MACHINE

[75] Inventors: Heinz Focke; Oskar Balmer, both of Verden, Fed. Rep. of Germany

[73] Assignee: Focke & Co., (GmbH & Co.), Verden, Fed. Rep. of Germany

[21] Appl. No.: 359,302

[22] Filed: May 31, 1989

[30] Foreign Application Priority Data

Jun. 18, 1988 [DE] Fed. Rep. of Germany ..... 3820735
Aug. 17, 1988 [DE] Fed. Rep. of Germany ..... 3827917

[51] Int. Cl.[5] ..... B65G 47/36

[52] U.S. Cl. ..... 198/468.8; 198/485.1; 198/465.4; 414/391; 414/609; 414/911; 242/35.5 A

[58] Field of Search ..... 198/465.4, 468.6, 468.8, 198/486.1, 485.1, 678; 414/389, 391, 609, 910, 911, 331; 104/88 R; 105/390; 242/35.5 A; 131/58, 280

[56] References Cited

U.S. PATENT DOCUMENTS 2,348,112 5/1944 DaCosta ..... 198/485.1
3,610,448 10/1971 Bornfleth ..... 198/468.6
3,615,003 10/1971 Rust ..... 198/678

FOREIGN PATENT DOCUMENTS 3632237 4/1988 Fed. Rep. of Germany .
3742112 6/1988 Fed. Rep. of Germany .
3714060 7/1988 Fed. Rep. of Germany .
3721091 1/1989 Fed. Rep. of Germany .

*Primary Examiner*—Joseph E. Valenza
*Attorney, Agent, or Firm*—Sughrue, Mion, Zinn, Macpeak & Seas

[57] ABSTRACT

The feeding of web-shaped wound packaging material (reels) and/or prefabricated blanks to high-performance packaging machines has hitherto required considerable manual involvement. Above all, the sometimes considerable dead weight of the packaging material has an adverse effect here. To allow a virtually full automatic feed of the packaging machines with packaging material, a conveyor track (31) leads to the individual consumption points at the packaging machines is arranged above the packaging machines. Individual reels (26, 27, 28) or blanks (82) stacked in cassettes (84) are transported along this conveyor track (31) by means of respective material conveyors (41) which are each equipped with material holders (44) that consist solely of rigid immovable supporting members for the reels or cassettes (84). The feed and discharge of these material holders (44) take place automatically as a result of an appropriate relative movement of feed and discharge members.

9 Claims, 13 Drawing Sheets

APPARATUS FOR TRANSPORTING PACKAGING MATERIAL TO A PACKAGING MACHINE

BACKGROUND OF THE INVENTION

The invention relates to an apparatus for transporting packaging material, especially reels of web-shaped packaging material, from a stock to at least one reception station, especially in the region of a packaging machine, with material conveyors which are movable along a conveyor track (rail line) extending above the packaging machines.

For the feeding of high-performance cigarette-packaging machines or so-called lines consisting of several packaging machines one following the other and performing different functions, there has already been proposed a conveying system for the packaging material, in which web-shaped packaging material in the form of reels is fed to the individual consumption points in the region of the packaging machines by a circular conveyor with a plurality of rotating supporting members, each receiving a reel. The reels are conveyed up to the circular track in the region of a loading station by a feed conveyor and are taken over automatically by reel carriers. The reels are taken over in reverse order in the region of the packaging machine by a discharge conveyor. For receiving the reels during transport, the rotating conveyor members are equipped with a supporting journal which enters a central orifice in the reel. The supporting journal is mounted on a supporting arm rotatable about a vertical axis (DE-A-3,632,237 corresponding to U.S. Pat. No. 4,907,689 issued Mar. 13, 1990).

SUMMARY OF THE INVENTION

The present invention contains an alternative solution to the known transport system described above.

The object on which the invention is based is to design the transport system for packaging material so that it is of universal use, guarantees maximum safety during automatic transport of the packaging material and allows the automatic transfer of the packaging material from one conveyor member to the next.

To achieve this object, the apparatus according to the invention is characterized in that the material conveyors have material holders with rigid immovable supporting members for the positive reception of reels of differing size (diameter and/or width).

One aim of the invention is to design the transport system in such a way that the material carriers running along a conveyor track have no movable members, with the exception of a bogie guided on the rail line. The material holder arranged on a bogie or the like therefore consists solely of rigid immovable supporting members which are nevertheless designed so that reels of differing size can be received in an exact relative position and without the danger of shifts during transport.

A further problem of the mechanized transport of packaging material is thus dealt with: in the production of cigarette packs, especially of the hinge-lid type, packaging material for which reels of differing size are available have to be processed. To make a collar of the above-mentioned type of pack, reels of large diameter, but of relatively small width must be processed. Reels of tinfoil (inner wrapping of the cigarettes) have a larger width, but a smaller diameter than the above-mentioned reels. Finally, plastic films, the reels of which have a large width, but a relatively small diameter, serve for the outer wrapping of the cigarette packs. These reels of differing size are to be grasped and fixed reliably by means of a standard material carrier or reel holder.

For this purpose, according to the invention the material holder is designed with rigid supporting spars, on which the particular reel to be transported rests with its circumferential surface. The supporting spars have steps which are formed by depressions and which, depending on the width of the reel, rest as side fences against side faces of the reel. Depending on the size (width) of the reel, this is automatically aligned with the appropriate side fences during the take-over by the material holder.

A further feature is that the members for transporting the packaging material are of universal design and also allow blank stacks in containers or cassettes to be conveyed. These are designed so that they can be received on supporting members of the conveyors, especially on the material holders of the bogies.

Another important subject of the invention is the transfer of the material, that it to say the reels or cassettes, from one or more feed conveyors to the material carriers of the conveyor track and, conversely, from these to discharge conveyors. The feed conveyors and discharge conveyors are equipped with supporting members for the articles (reels, cassettes) which in terms of arrangment and form are matched to the material holders, so that an automatic transfer of the reels can take place. For this, in the region of the feed stations and of the discharge stations there is a relative movement between the material holder and the supporting member of the feed conveyor or of the discharge conveyor, specifically preferably in the vertical direction. The reel is thereby transferred from one conveyor member to the other.

In the region of a discharge station, that is to say at a packaging machine, the reels are transferred from the discharge conveyor conveying up and down to a reel magazine of the packaging machine, specifically in a similar way to the transfer of the reel from one conveyor to the other. In this process the supporting member of the discharge conveyor is moved into a position underneath bearing members of the reel magazine, transfer to the latter thereby taking place.

Further details of the invention relate to the design of the material conveyors, of the conveyor track (rail line) and of the feed and discharge conveyors.

BRIEF DESCRIPTION OF THE DRAWINGS

Exemplary embodiments of the invention are explained in detail below by means of the drawings. In these.

DETAILED DESCRIPTION OF A PREFERRED EMBODIMENT

Figure 1:
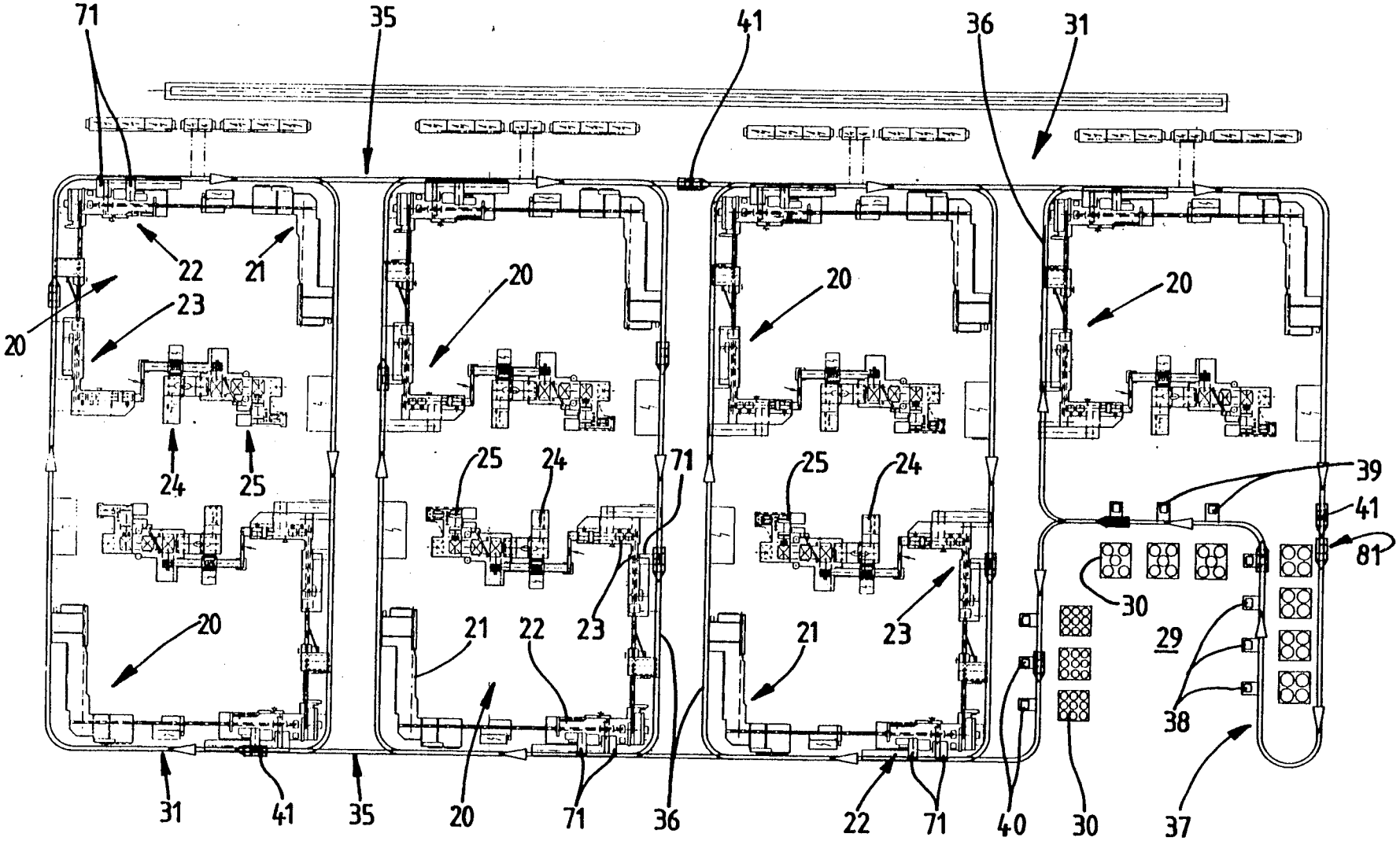
FIG. 1 shows a simplified planned view of an installation with a plurality of packaging machines to be supplied with packaging material, FIG. 2 likewise shows a planned view of a detail of the installation according to FIG. 1 on an enlarged scale.
Figure 2:
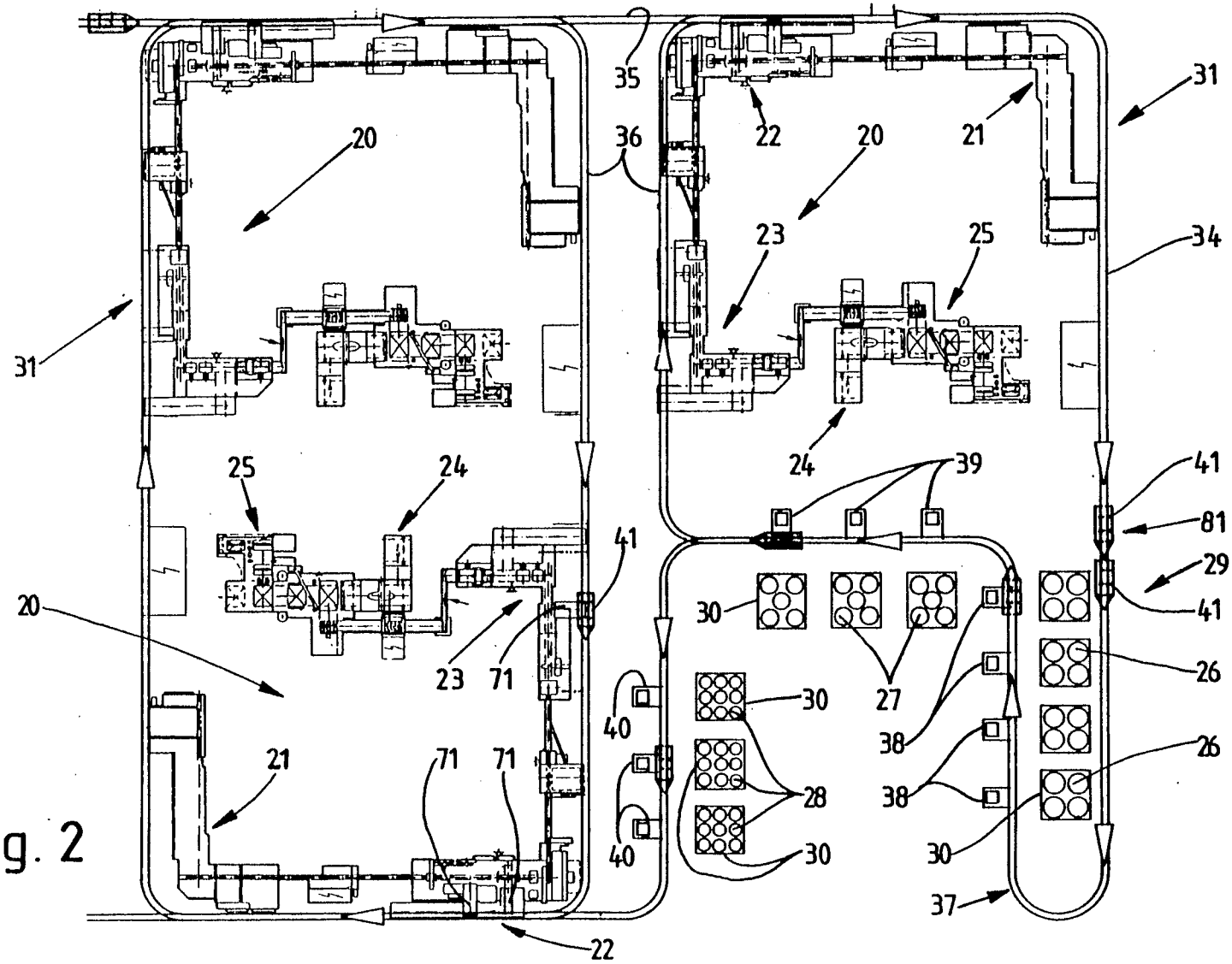
Figure 4:
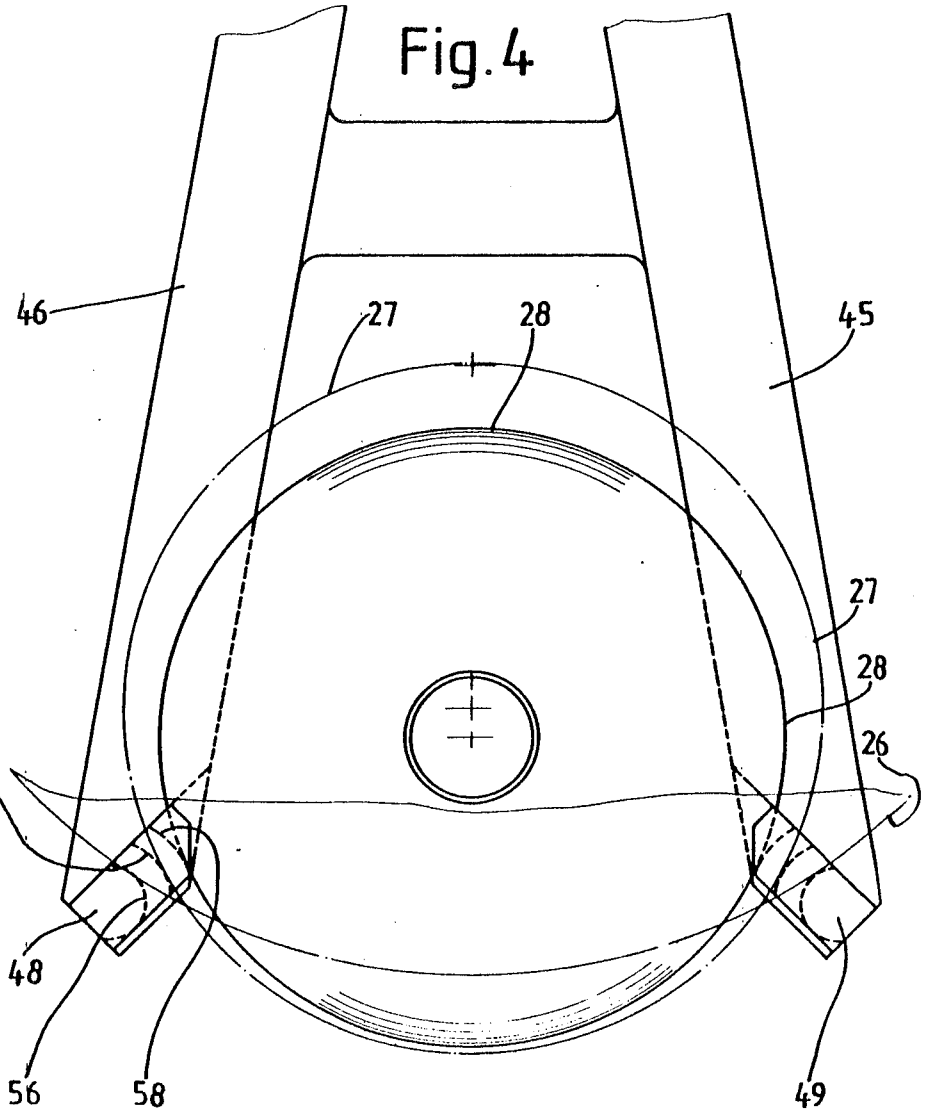
FIG. 4 shows an end view of the detail according to FIG. 3.
Figure 3:
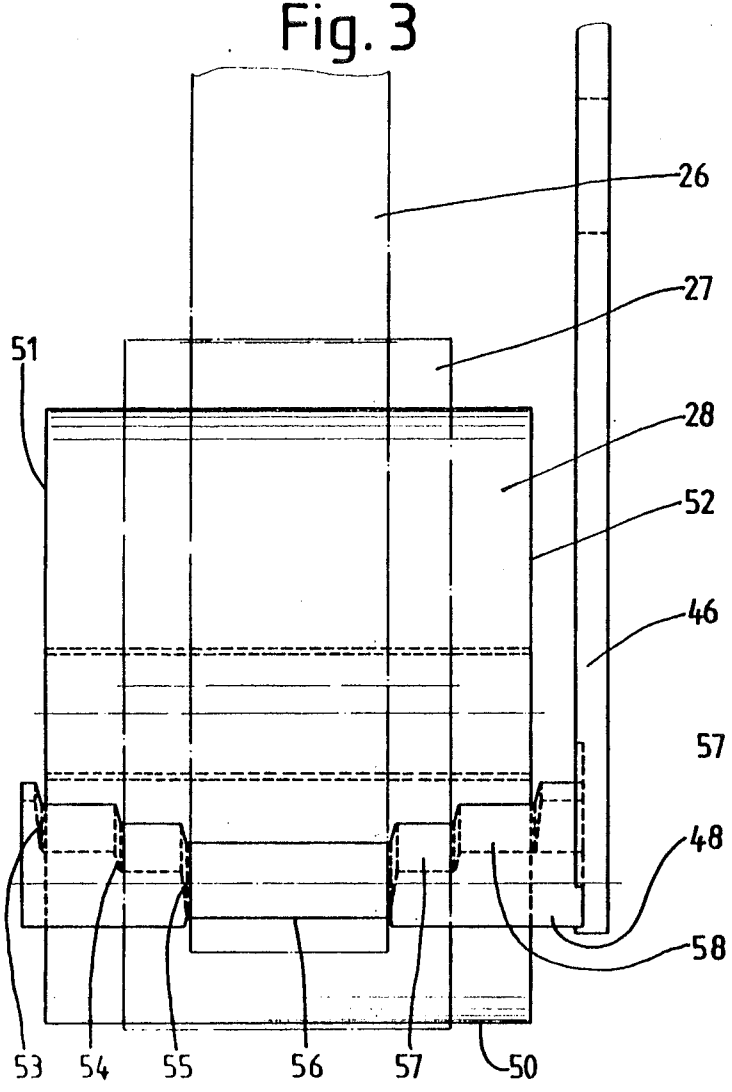
FIG. 3 shows a side view of a detail of a material holder as part of a material conveyor on a greatly enlarged scale.

The drawings relate, in the exemplary embodiment, to the feeding of packaging machines for cigarettes, specifically especially of the hinge-lid type. A cigarette production and packaging installation accommodated in a factory building consists of a plurality of so-called lines 20. Each of these lines 20 consists of a cigarette-making machine 21, a packaging machine 22 for making the (cigarette) pack, that is to say the hinge-lid pack, a wrapping machine 23 for making an outer wrapping of the pack from plastic film, a bundle packer 24 and a carton packer 25. The latter serve for the production of small bundles ("cigarette sticks") and of carton packs.

Several of these lines 20 are to be supplied automatically with packaging material. The exemplary embodiment illustrated is concerned, above all, with the feeding of web-shaped packaging material provided in the form of reels. On the one hand, collar reels 26 are to be fed. These collar reels 26 of small width (in the axial direction), but of large diameter serve for making collars which are to be inserted into the hinge-lid packs as part of the latter.

Furthermore, tinfoil reels 27 are to be fed to the packaging machines, particularly to the wrapping machine 23. Tinfoil reels 27 have a smaller diameter, but a larger ("mean") dimension in the axial direction.

The reels of smallest diameter with the largest dimension in the axial direction are poly-reels 28, that is to say reels of web-shaped plastic film as an outer wrapping of the pack for the wrapping machines 23.

A relatively large stock of packaging material of the above type is located in the region of a railway station 29. The reels are arranged on respective pallets 30.

The packaging material, particularly the reels 26, 27, 28, are fed along a conveyor track 31, particularly along a rail line, to the individual consumption points in the region of the packaging machines. The conveyor track 31 is arranged above the packaging machines, especially suspended from a ceiling or from a supporting structure of the factory building. In the present exemplary embodiment, the conveyor track 31, in particular a running rail 32 of the latter, is mounted on a supporting rail 34 by means of adjustable suspension carriers 33.

In the exemplary embodiment illustrated, the conveyor track 31 so formed is designed as a closed continuous rectangular track with transverse rails 36 branching off from a main rail 35 via switch points. Each consumption point of each packaging machine can be reached via the rail system designed in this way.

In the region of the railway station 29, the main rail 35 is guided in the form of a loop 37, thus providing sufficient room for feed stations of individual reel types.

According to the consumption of packaging material or the capacity of the individual reels, four feed stations 38 for collar reels 26, three feed stations 39 for tinfoil reels 27 and three feed stations 40 for poly-reels 28 are provided in the present case. In the region of this feed station 38, 39, 40 the reel required on a particular occasion by a consumption point is placed in the transport path and automatically fed to the packaging machine 22 (collar reels, tinfoil reels) or to the wrapping machine 23 (poly-reels). Furthermore, feed stations for further packaging material can be provided, for example for the production of bundles in the region of the bundle packer 24.

The individual reels 26, 27, 28 are each transported by a material conveyor 41 which is movable along the conveyor track 31 as far as the particular consumption point requiring material. The entire conveyor system has a plurality of such material conveyors 41 which are movable independently of one another.

The material conveyor 41 consists of a conventional bogie 42 of known design which, is mounted movably on the running rail 32 by means of a plurality of running rollers. Each bogie 42 is assigned its own drive motor 43.

A receiver for one reel at a time, particularly a material holder 44 of special design, is arranged suspended on the underside of the bogie 42. This material holder 44 is arranged fixedly, that is to say immovably, on the bogie 42 and consists solely of rigid immovable parts.

Figure 5:
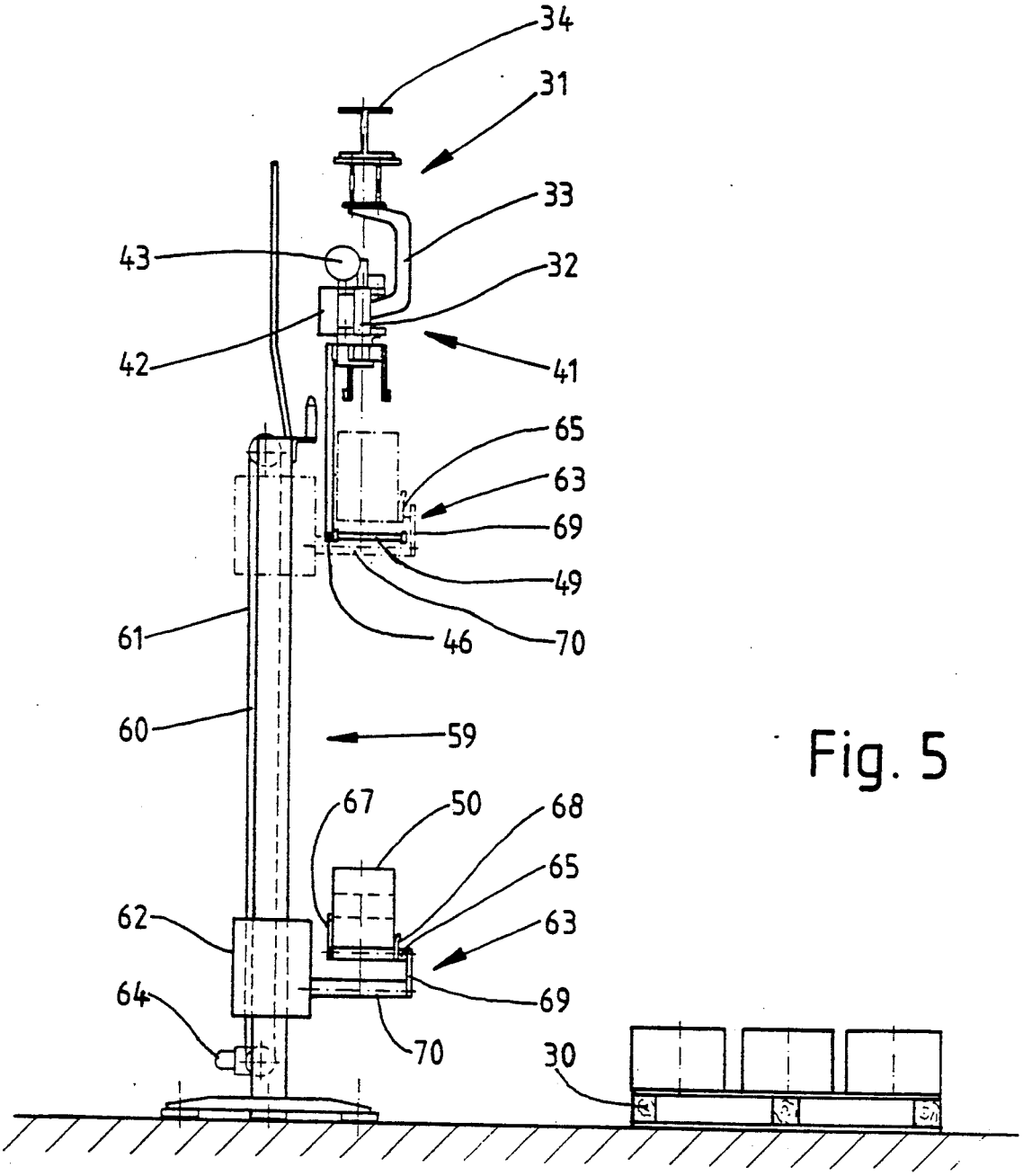
FIG. 5 shows a transverse view of a conveyor track in the region of a feed station.
Figure 9:
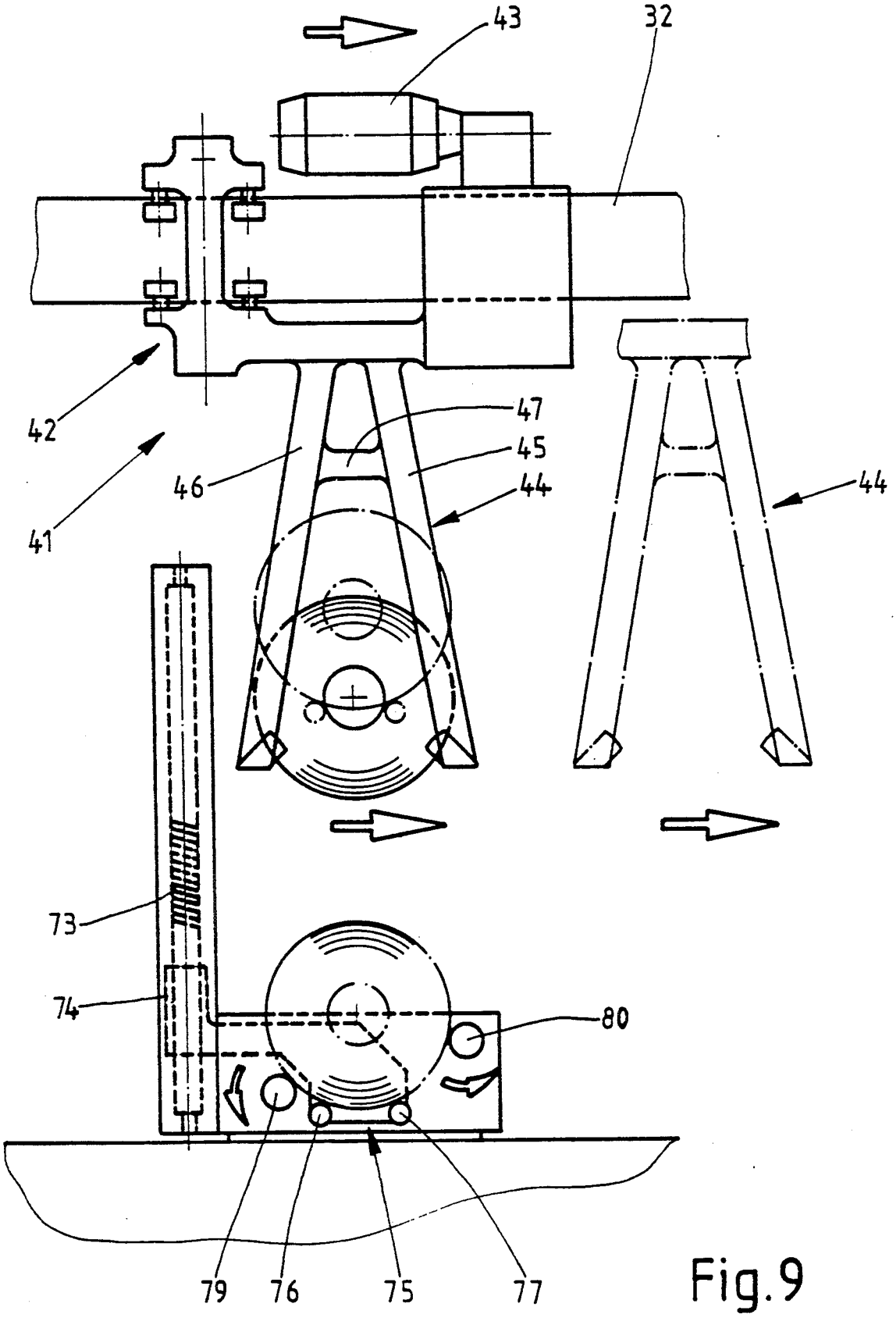
FIG. 9 shows a side view of FIG. 8 (corresponding to FIG. 7) on an enlarged scale.

As is evident especially from FIG. 9, the material holder 44 consists of two downwardly divergent supporting struts 45, 46 which are secured here by means of a transverse strut 47. The supporting struts 45, 46 are attached to the bogie 42 excentrically, that is to say offset relative to the vertical longitudinal midplane of the latter (for example, FIG. 5).

Horizontal supporting spars 48, 49 pointing transversely relative to the conveying direction are located as supporting or bearing members for the reel at the lower ends of the supporting struts 45, 46. The supporting spars 48, 49 are attached rigidly, as parts projecting, that is to say jutting out, on one side, to the supporting struts 45, 46, specifically in such a way that a reel received by the supporting spars 48, 49 is held essentially centrally underneath the bogie 42.

The reels rest with their circumferential surface 50 on the supporting spars 48, 49. To protect the reel resting vertically on the supporting spars 48, 49 against transverse or tilting movements, the material holder 44 is designed with rigid side holders which rest supportingly against side faces 51, 52 of the reels. In the exemplary embodiment illustrated, these side holders assigned respectively in pairs to a reel are formed by fixed side fences 53, 54, 55 of the supporting spars 48, 49. For this purpose, these are made step-shaped in the longitudinal direction, so that depressions of differing length in the direction of the supporting spars 48, 49 are obtained. The vertical or slightly divergingly inclined step faces of the steps thus formed constitute the side fences 53, 54, 55.

The distances between side fences 53 to 55 interacting in pairs are adjusted to the dimensions of the reels. The reel with the smallest dimension in the axial direction (collar reel 26) rests in an approximately central depression 56 of the supporting spars 48, 49. This reel is held laterally by the side fences 55 arranged at the least distance from one another. A depression 57 formed at a higher level and with supporting surfaces on both sides of the middle depression 56 serves for receiving a tinfoil reel 27 between side fences 54. Finally, there is provided a depression 58 of the smallest depth, but of the greatest width for receiving poly-reels 28 between the outer side fences 53. During the loading of a material conveyor 41, the reels are centred automatically according to their size with the associated depression 56, 57, 58.

Figure 6:
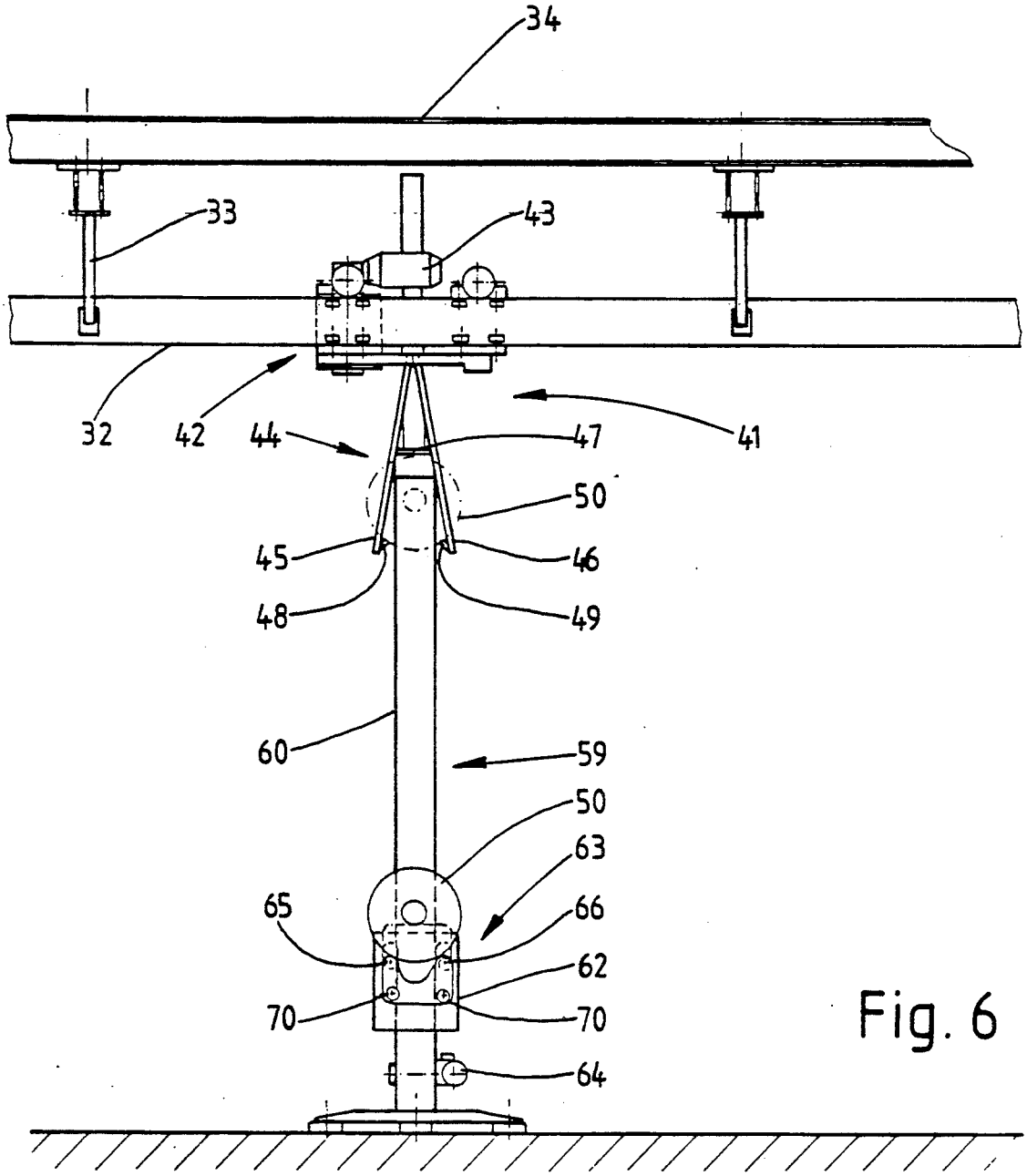
FIG. 6 shows a side view of the detail according to FIG. 5 offset 90° relative to that of FIG. 5.
Figure 7:
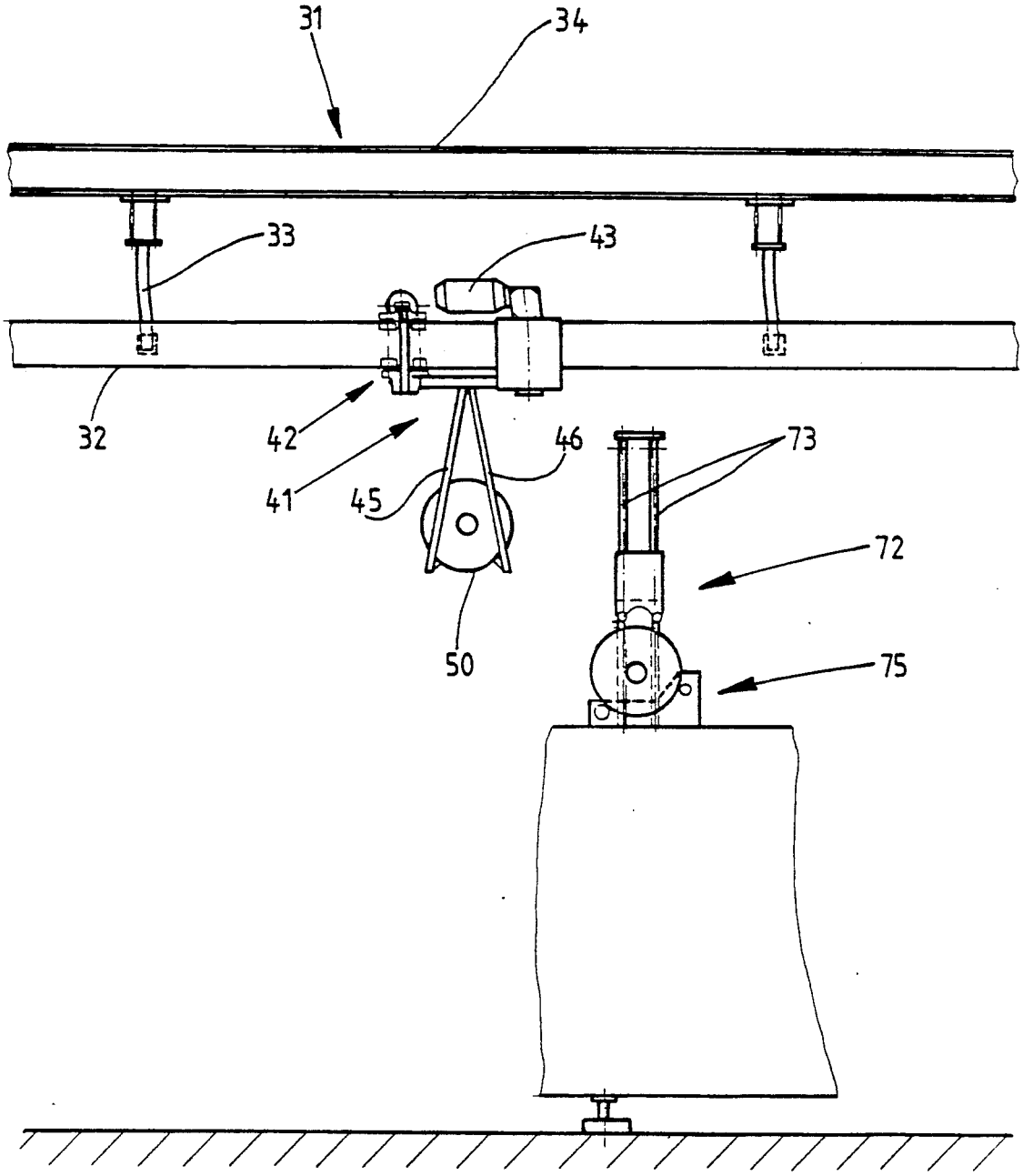
FIG. 7 shows a representation corresponding to that of FIG. 6 in the region of a discharge station.

For feeding the material conveyors 41, in each feed station 38, 39, 40 there is a feed conveyor 59 conveying upwards. This consists, here, of a vertical supporting column 60 with an endless conveyor, for example a toothed belt 61. By means of this, a material receiver 63 mounted on a holding frame 62 is moved up and down. In a lower position (represented by unbroken lines in FIGS. 5 and 6), the material receiver 63 is loaded with a reel, for example by hand. In an upper position (represented by dot-and-dash lines in FIGS. 5 and 6), the automatic transfer of this to a material conveyor 41 takes place. For this purpose, the toothed belt 61 is driven in both directions by means of a motor 64.

The material receiver 63 is designed in a special way. The reel rests with its circumferential surface 50 on two supporting rods 65, 66 arranged at a distance from one another. Stop pieces 67, 68 are located on these at a suitable distance from one another. The supporting rods 65, 66 are connected excentrically via a support piece 69 to (two) holding rods 70 which themselves are attached as a jutting-out supporting member to the holding frame 62. The actual material receiver 63 is thus free in the region below the reel and on one side.

In the upper transfer position of the material receiver 63, the latter is in such a relative position in relation to the material conveyor 41 that the supporting rods 65, 66 extend in a plane above the plane of movement of the supporting spars 48, 49 of the material conveyor 41. This can be moved into the feed station, and the supporting struts 45, 46 can move passed the reel and the supporting rods 65, 66 on the side located opposite the support piece 69 of the material receiver 63, whilst the supporting spars 48, 49 run through underneath the reel between the latter and the holding rod 70. To take over the reel, the material conveyor 41 is stopped in the feed station 38, 39, 40 so that the supporting spars 48, 49 are aligned with the reel. As the result of a downward movement of the material receiver 63, the reel is deposited on the supporting spars 48, 49. In the present case, the distance between these is greater than the distance between the supporting rods 65, 66, so that these can be moved downwards passed the supporting spars 48, 49, particularly between them, into the lower receiving position.

The discharge of the material conveyor 41 in the region of a discharge station 71 at the packaging machine 22 or at the wrapping machine 23 takes place in a similar way. A discharge conveyor 72, likewise a vertical conveyor, is located in the region of each of these discharge stations. The discharge conveyor 72 can be arranged on the packaging machine 22 or wrapping machine 23 or next to it. In the exemplary embodiment shown, the discharge conveyor is designed as a spindle conveyor with one (or two) vertical rotatable spindle rod(s) 73, on which a spindle sleeve 74 is movable up or down during the rotation of the spindle rod 73.

A material carrier 75 of a design similar to that of the material receiver 63 is mounted on the spindle sleeve 74. This is designed as a laterally projecting arm with two supporting rods 76, 77 arranged at a distance from one another and jutting out on one side for receiving a reel.

Figure 10:
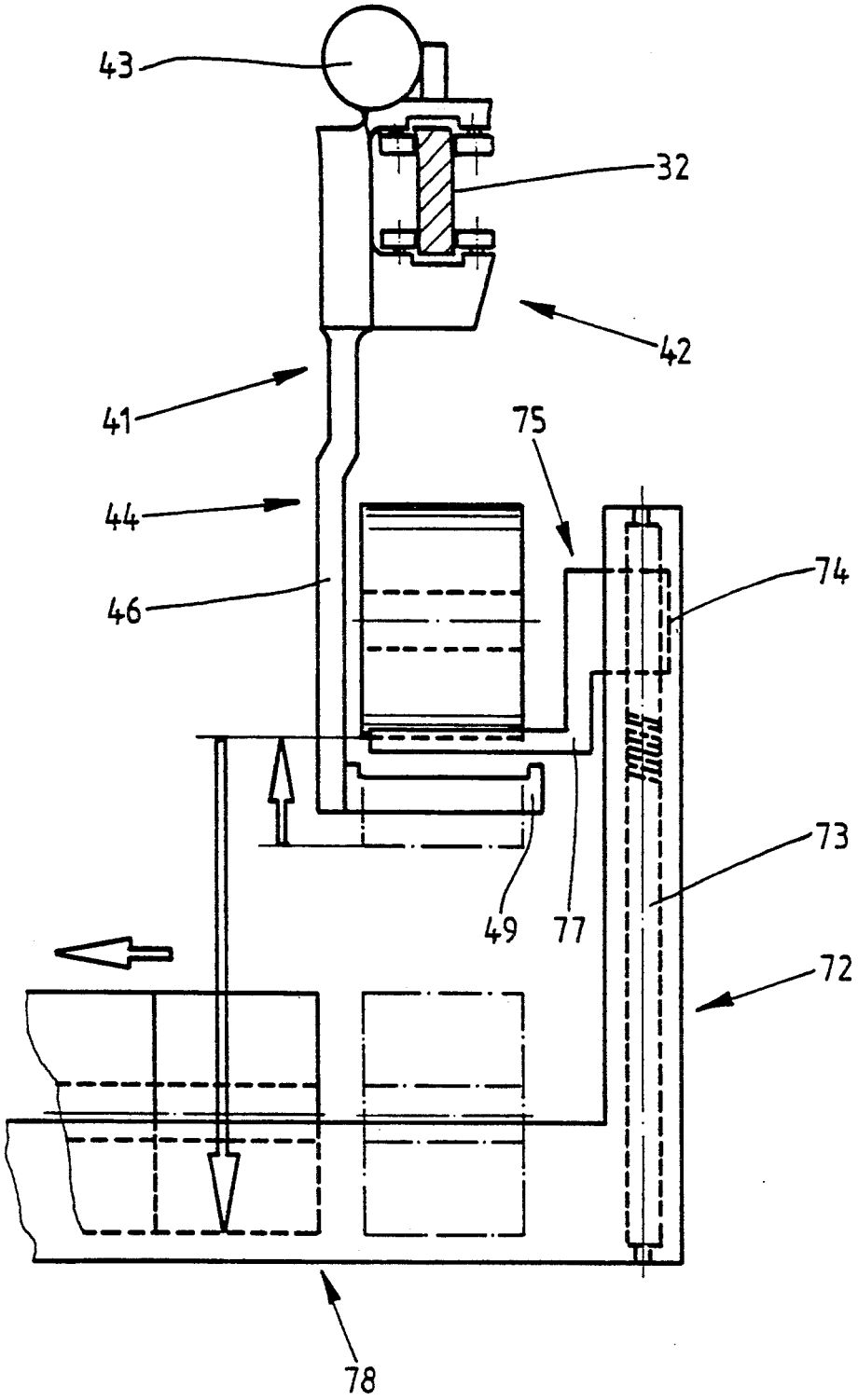
FIG. 10 shows a further representation in the region of the discharge station in a transverse view and in cross-section with a changed relative position.
Figure 11:
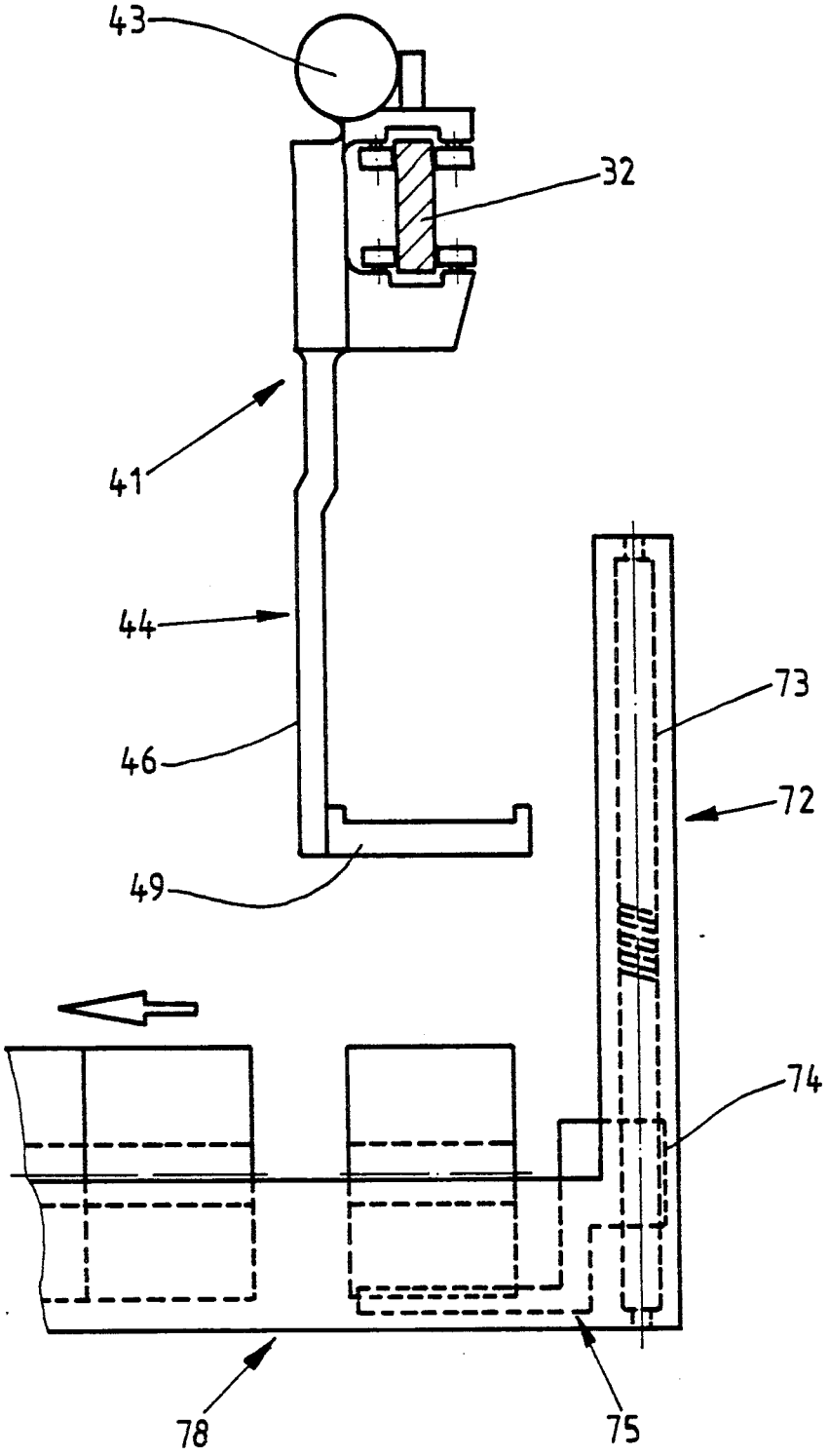
FIG. 11 shows a representation corresponding to that of FIG. 10 with a further changed relative position.
Figure 12:
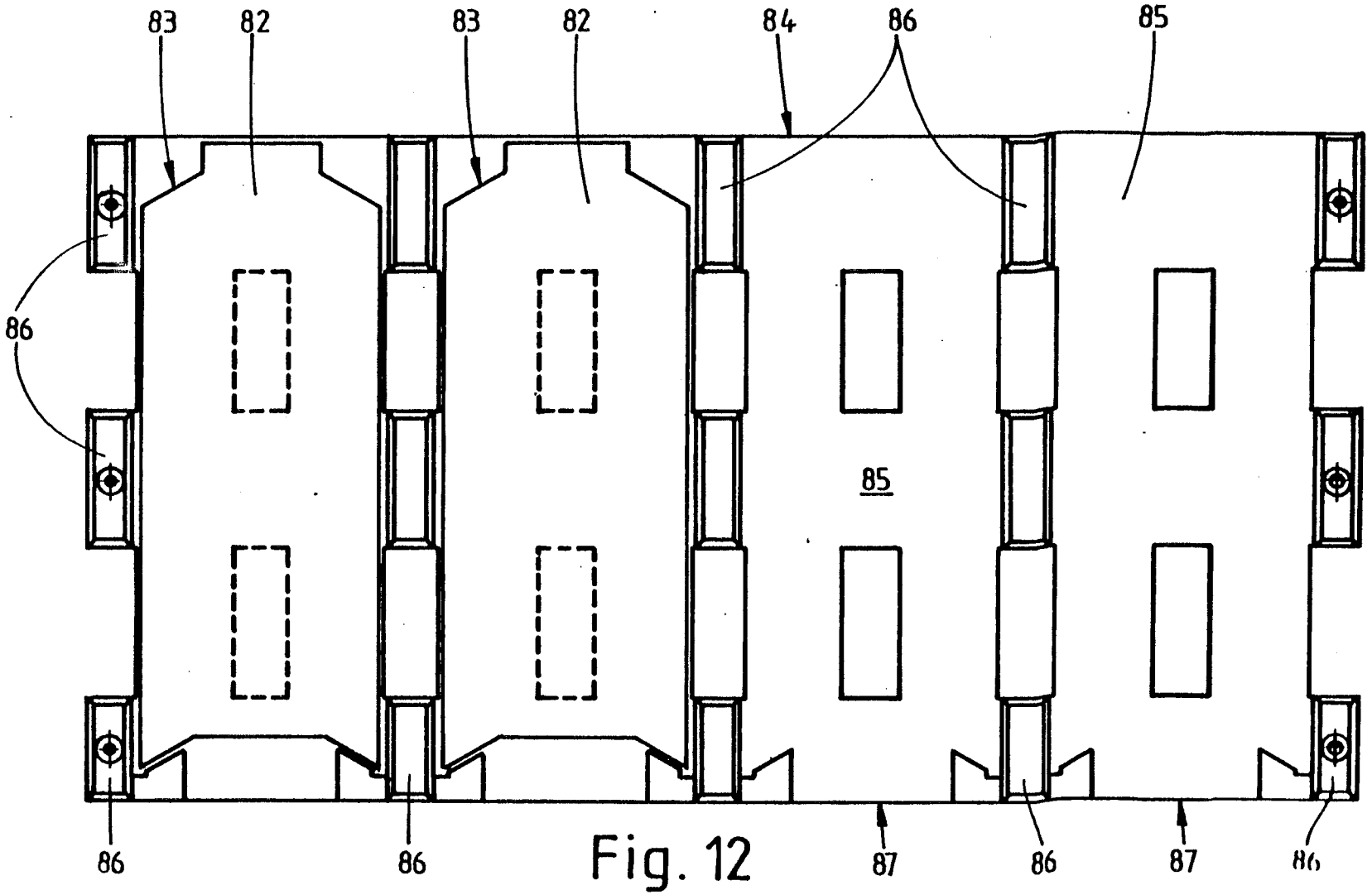
FIG. 12 shows a plan view of a cassette for receiving blank stacks.
Figure 13:
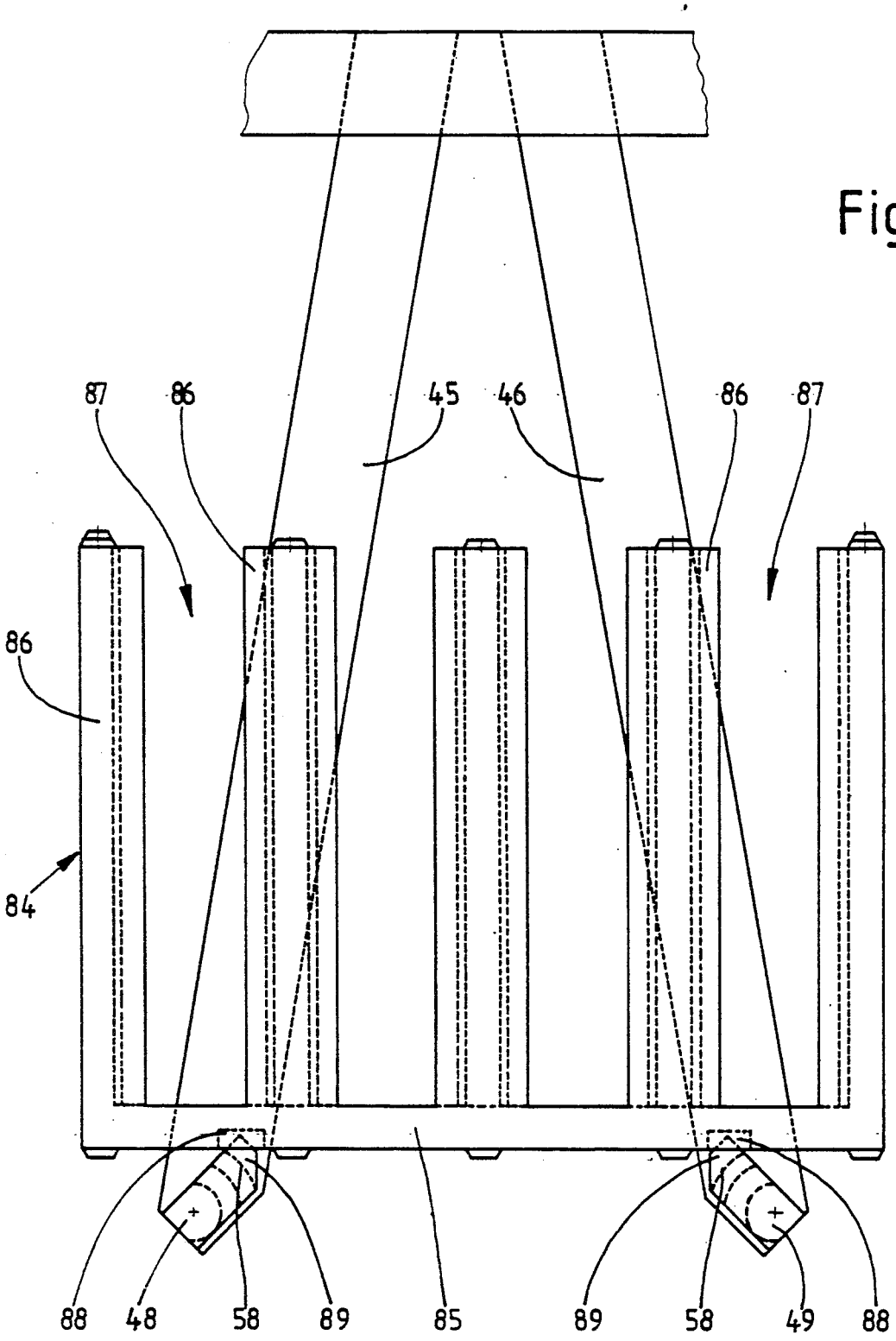
FIG. 13 shows a side view of part of a material holder with a cassette.
Figure 14:
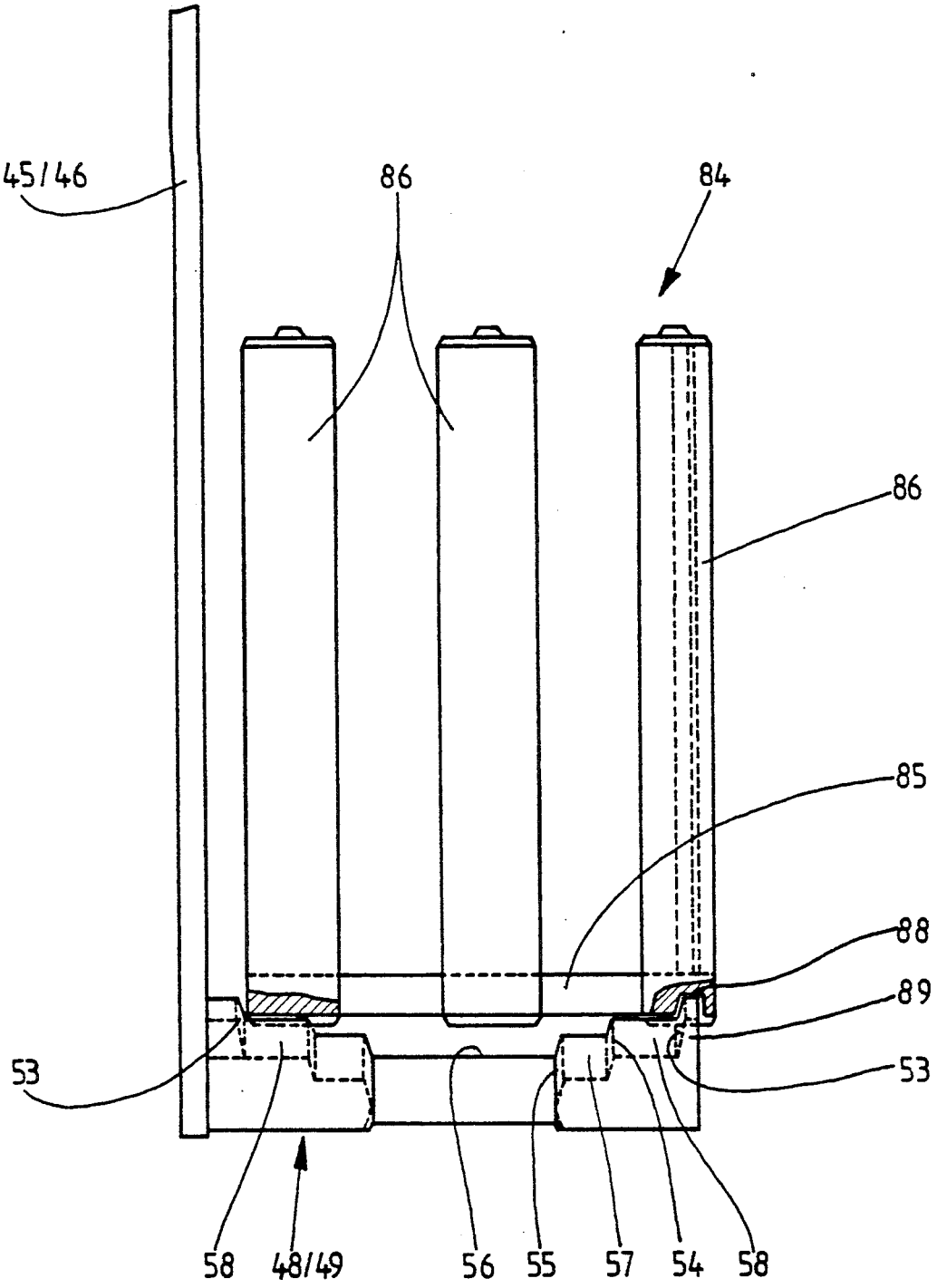
FIG. 14 shows a representation according to FIG. 12 in a transverse view offset 90°, partially in section.

The transfer of a reel brought up by the material conveyor 41 to the discharge conveyor 72 or to its material carrier 75 takes place in a similar way to the loading operation. In the discharge station 71, the material holder 44 of the material conveyor 41 is aligned with the material carrier 75, while the latter is still in a lower position (FIG. 9). As the result of an upward movement of the material carrier 75, its supporting rods 76, 77 are moved through between the supporting spars 48, 49 of the material holder 44. The supporting rods 76, 77 thereby take over the reel which at the same time is lifted off from the supporting spars 48, 49. In the upper end position (represented by dot-and-dash lines in FIG. 9 or shown in FIG. 10), the material carrier 75 with the reel is located so far above the supporting spars 48, 49 that the material conveyor 41 can be moved further on the running rail 32. The material carrier 75 with the reel is now moved downwards for the transfer of the reel to the packaging machine or a reel magazine 78.

The above-mentioned relative movement of the conveyor and supporting members for reels, with the transfer of these from one conveyor member to the other, is possible because the material holder 44 on the one hand and the material carrier 75 of the discharge conveyor 72 on the other hand are mounted on different sides of the reel or of the conveyor track of the latter excentrically as jutting-out members and can therefore be moved passed one another in a fault-free way at differing distances between the supporting parts.

Figure 8:
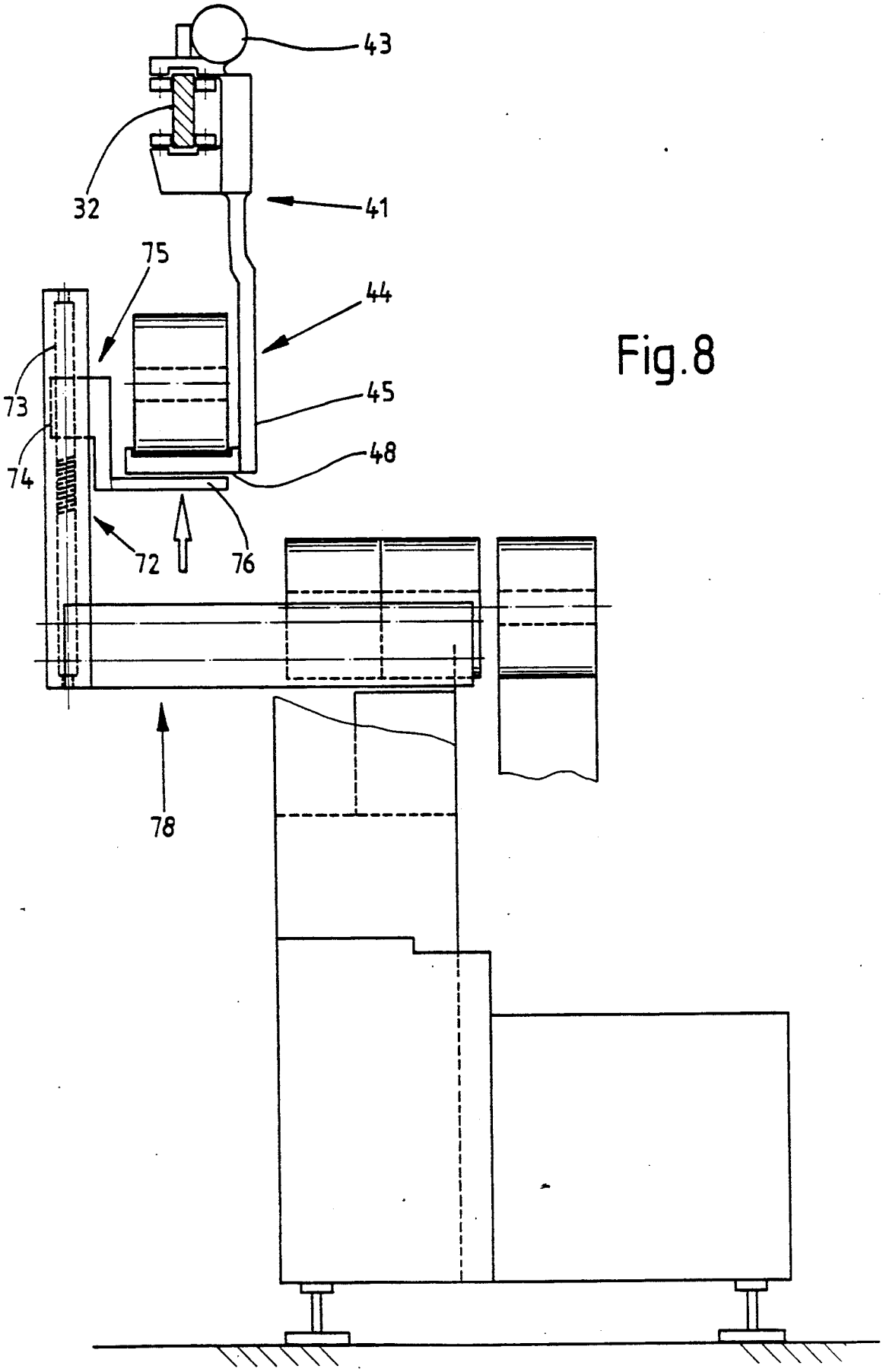
FIG. 8 shows a transverse view and vertical section of the discharge station according to FIG. 7 on an enlarged scale.

In the exemplary embodiment illustrated, the reel magazine 78 is designed in a special way, in particular consisting of two magazine rods 79 and 80 extending approximately axis-parallel relative to the deposited reels. The reels rest with their circumferential surfaces 50 on these magazine rods 79 and 80. The magazine rods 79, 80 are driven in rotation, specifically in the same anti-clockwise direction (in FIG. 9). The reels resting on the magazine rods 79, 80 are thereby likewise set in rotation. Furthermore, the magazine rods 79, 80 are arranged so as to diverge slightly in the conveying direction of the reels. This, because of the rotation of the magazine rods 79, 80, results in a constant gradual conveying movement in the direction of the divergence of the magazine rods 79, 80. In the present case, the reels are thereby conveyed successively from the rear of the packaging machine to the front or into the region of a processing station (for example, from left to right in FIG. 8). The processing of the reels then takes place in a suitable known way.

As can be seen especially in FIG. 9, the magazine rods 79, 80 are arranged vertically offset relative to one another. The magazine rod 80 located on the right in the predetermined direction of rotation is the higher. The distance between the magazine rods 79, 80 is such that the supporting part of the material carrier 75, together with the reel, can be moved downwards through between the magazine rods 79, 80 into a lower transfer position, in which the reel is taken over by the magazine rods 79, 80 and the supporting rods 76, 77 come free at the bottom.

In the present exemplary embodiment, the conveyor track 31 is designed so that the material conveyors 41 are always moved in one direction only. Accordingly, after a material conveyor 41 has been discharged, the latter is transported further in the conveying direction marked by arrows, until it reaches the railway station 29. A storage zone 81 for material conveyors 41 temporarily not in use is arranged in the region of this. The orbital path of the material conveyors 41 always in the same direction can be shortened by means of the transverse rails 36 connected to the main rails 35 via switch points, so that the path which is the most favourable in functional terms is always chosen.

The transport installation is preferably operated fully automatically. When a predetermined minimum stock of material (reels) is reached in the region of a reel magazine 78, the appropriate material is requested. In this case, first a material conveyor 41 waiting in the region of the storage zone 81 is automatically set in motion and delivered to a free feed station 38, 39, 40 for the particular packaging material requested. The material conveyor 41 waits here until it is loaded with the respective reel. Transport is then continued by the material conveyor 41 until the particular requesting consumption point or discharge station 71 is reached. Because circulation is always in the same direction, the material conveyor 41 sometimes has to cover a certain detour distance. After discharge, the return to the railway station 29 or to the storage zone 81 of the latter takes place.

The material conveyors 41 can be controlled in various ways. A solution in which the material conveyors 41 each receive control pulses in the region of holding positions via the running rail has proved favourable. Accordingly, no control pulses are transmitted during the running movement of the material conveyor 41. Control lines therefore need only ever be laid at the predetermined and fixed holding stations. Located in the region of the running stretches of the material conveyors 41 are sensors which trigger control pulses according to the particular positions, especially infra-red light barriers with a transmitter and receiver. This guarantees automatic destination control and destination location for the material conveyors 41. The drive of the material conveyor 41 (drive motor 43) is obtained by means of conductor rails and brush contacts.

A further special feature of the exemplary embodiment illustrated is that the members provided for the transport of the packaging material are of universal use and can also carry out the transport of blanks 82. The blanks 82 can consist, for example, of thin cardboard and serve for the production of hinge-lid (cigarette) packs. Blanks of this type are conventionally produced outside the cigarette packaging installation, especially in a paper factory, and delivered as a blank stack 83. In the present exemplary embodiment, several blank stacks 83 are received in a container, particularly a cassette 84 designed in a special way. This consists essentially of a bottom wall 85, on which the blank stacks 83 rest. Partition-wall parts, particularly vertical webs 86, are fastened on the bottom wall 85. These are aligned in longitudinal and transverse rows, so that several chambers 87 arranged next to one another, each receiving a blank stack 83, are formed on the bottom wall 85. The chambers 87 are open at the top and on one longitudinal side of the cassette 84 for the introduction of the blank stacks 83 and for the extraction of these. Furthermore, the cassettes 84 are designed so that several (empty) cassettes can be nested one in the other for space-saving storage or for the (return) transport to the paper factory.

The cassettes 84 on the one hand and the conveyor members on the other hand are designed so that, alternatively to the reels, cassettes 84 with blank stacks 83 can be transported. For this, the design of the material holders 44 arranged on the material conveyors 41 is of special importance. A particular cassette 84 is received on the supporting spars 48, 49 of the material holder 40. The bottom wall 85 rests on these supporting members.

To secure the cassette 84 on the material holder 44, projections of the supporting spars 48, 49 enter depressions 88 on the underside of the bottom wall 85. The projections concerned are noses 89 at the respective ends of the supporting spars 48, 49. The noses 89 are obtained as a result of the already described design of the supporting spars with step-like fences for receiving reels of differing size. The dimensions of the cassette 84 are such that it rests on the bearing surfaces or steps for the largest reel (in terms of the axial dimension), that is to say in the depression 58.

The vertical conveyors of the conveyor installation, particularly the feed conveyor 59 and the discharge conveyor 72, are also designed so that a particular cassette 84 can be raised and lowered, instead of the reels, without any change in construction. The transfer of the cassettes 84 to the material conveyor 41 or to the material holder 44 takes place in the same way as described with reference to the reels.

The above-described feed of prefabricated blanks 82 to a packaging machine 22 is intrinsically new. The conveyor installation or its individual conveyor members can therefore also be designed so that they are suitable only for the transport of containers (cassettes) with blank stacks 83.

In the region of the packaging machine 22, the cassettes 84 are deposited on a cassette conveyor located at the machine and are then discharged stack by stack.

What is claimed is:

1. An apparatus for transporting packaging material, especially reels of web-shaped packaging material, from a stock to at least one reception station in a region of at least one of a plurality of packaging machines, said apparatus comprising:

a plurality of material conveyors (41) which are movable along a conveyor track extending above the packaging machines and each of which has a material holder (44) with rigid immovable supporting members (48, 49) for the positive reception of reels (26, 27, 28) of different sizes, the reels resting with their circumferential surface (50) on said supporting members (48, 49); and at least one transfer conveyor in the region of a feed station (38, 39, 40) and at least one transfer conveyor in the region of a discharge station (71), and each having a material carrier (63, 75) which is movable upwardly and downwardly for receiving or transferring a reel from or to a material conveyor (41);

said material carrier (63, 75) being arranged in the region of the conveyor track of said material conveyor (41), and the design of said material carrier (63, 75) being matched to the design of said supporting members of said material holder (44), such that supporting members (48, 49), located in the path of upward movement of said material carrier, and said material carrier (63, 75) pass one another during an upward movement of said material carrier, while at the same time a reel is transferred by one transfer conveyor lifting it off the other, wherein said material holder (44) comprises rigid supporting struts (45, 46) and at least two spaced-apart supporting members designed as unidirectional supporting spars (48, 49) having free ends, each of said supporting spars (48, 49) projecting from a respective supporting strut (45, 46) such that the free ends of said supporting spars are approximately parallel to one another, said supporting spars projecting approximately perpendicular to a direction of movement of said material conveyors (41), wherein said material carrier (63, 75) has supporting rods (65, 66; 76, 77) which pass said supporting spars of said material holder (44) during the upward movement of said material carrier, and wherein said supporting rods of said material carrier (63, 75) are spaced at a sufficiently different distance that a pair of them can move through the space between said supporting spars of said material holder (44), and further wherein after a reel is transferred from the material holder (44) to the material conveyor (41), the reel moves along the material conveyor (41) and then the material carrier (63,75) moves downwards.

2. Apparatus according to claim 1, wherein in that the supporting spars (48, 49) have rigid side fences (53, 54, 55) for bearing against side faces (51, 52) of the reels of differing dimension in the axial direction.

3. Apparatus according to claim 2, wherein the supporting spars (48, 49) are made step-like, thereby forming depressions (56, 57, 58) of differing width and depth, the depressions (56, 57, 58) being limited respectively in pairs by the step-like side fences (53, 54, 55), and each depression (56, 57, 58) corresponding to the axial dimension of a reel.

4. Apparatus according to claim 1, wherein the material holder is mounted eccentrically on the material conveyor (41) in relation to its longitudinal mid-plane, and the supporting spars (48, 49), projecting on one side, are mounted on said rigid supporting struts (45, 46) of the material holder (44), in such a way that a reel received by the supporting spars (48, 49) is arranged approximately centrally relative to the bogie (42), and wherein said rigid supporting struts (45, 46) are downwardly divergent.

5. Apparatus according to claim 1, wherein one of said transfer conveyors is a discharge conveyor (72), and wherein the reels are deposited by the discharge conveyor (72), onto elongated magazine rods (79, 80) of a reel magazine (78), the magazine rods being arranged at such a distance from one another that the material carrier (75) is lowerable into a position below the magazine rods (79, 80), the reel thereby being transferred to said magazine rods.

6. Apparatus according to claim 1, wherein said material conveyors convey prefabricated new blanks (82) as a blank stack (83), in cassettes (84) open at the top, from said stock or said feed station to said reception station, each material holder (44) being adapted to receive a cassette (84).

7. Apparatus according to claim 6, wherein the supporting members (48, 49) of each material holder support a bottom wall (85) of a cassette (84).

8. Apparatus according to claim 7, wherein formed in the bottom wall (85) of the cassette (84) are depressions (88) into which penetrate projections or stops, in the form of upwardly directed noses (89), on free ends of the supporting members (48, 49) of the material holder (44).

9. Apparatus for transporting packaging material, especially reels of web-shaped packaging material, from a stock to at least one reception station, especially in the region of a packaging machine, with material conveyors which are movable along a conveyor track extending above the packaging machine, characterized:

in that each of the material conveyors (41) has a material holder (44) with two rigid immovable supporting spars (48, 49) for the positive reception of reels (26, 27, 28) of differing size;

in that said supporting spars (48, 49) of each material holder (44) are arranged at a distance from one another, support the reels on a circumferential surface (50) thereof, and are mounted on a bogie (42) movable on the conveyor track (31) or a running rail (32) of the latter and belonging to the material conveyor (41);

in that the supporting spars (48, 49) have rigid side fences (53, 54, 55) for bearing against side faces (51, 52) of the reels of differing dimension in the axial direction;

and in that the supporting spars (48, 49) are made step-like, thereby forming depressions (56, 57, 58) of differing width and depth, the depressions (56, 57, 58) being limited respectively in pairs by the step-like side fences (53, 54, 55), and each depression (56, 57, 58) corresponding to the axial dimension of a reel.

* * * * *